United States Patent [19]

Krummel et al.

[11] Patent Number: 4,616,158

[45] Date of Patent: Oct. 7, 1986

[54] ARRANGEMENT FOR SHUTTING OFF AN INVERTER

[75] Inventors: Peter Krummel, St. Georgen; Manfred Klamt, Trostberg, both of Fed. Rep. of Germany

[73] Assignee: Siemens Aktiengesellschaft, Berlin & Munich, Fed. Rep. of Germany

[21] Appl. No.: 563,170

[22] Filed: Dec. 19, 1983

[30] Foreign Application Priority Data

Dec. 23, 1982 [DE] Fed. Rep. of Germany ..... 3247863

[51] Int. Cl.[4] ..... H05B 37/03; H05B 41/24

[52] U.S. Cl. ..... 315/225; 315/127; 363/55; 363/56; 361/100

[58] Field of Search ..... 315/225, 127, 310, 74; 361/100; 363/55, 56

[56] References Cited

U.S. PATENT DOCUMENTS

| | | | |
|---|---|---|---|
| 4,168,453 | 9/1979 | Gerhard et al. | 315/225 |
| 4,336,563 | 6/1982 | Suzuki | 361/100 X |
| 4,455,509 | 6/1984 | Crum et al. | 315/225 X |
| 4,471,422 | 9/1984 | Hierholzer et al. | 363/56 |

FOREIGN PATENT DOCUMENTS

| | | | |
|---|---|---|---|
| 55-35272 | 3/1980 | Japan | 363/55 |
| 55-144780 | 11/1980 | Japan | 363/56 |
| 877696 | 10/1981 | U.S.S.R. | 363/55 |
| 970554 | 10/1982 | U.S.S.R. | 361/100 |

*Primary Examiner*—David K. Moore
*Assistant Examiner*—Vincent DeLuca
*Attorney, Agent, or Firm*—Hill, Van Santen, Steadman & Simpson

[57] ABSTRACT

A shut-off device is provided for an inverter which feeds at least one discharge lamp, the shut-off device operable to shut-off the inverter in limiting cases and remaining in this condition until a lamp replacement. The shut-off device flips into its normal condition when a holding current in a monitoring circuit falls below a flyback limit value. In order to keep the losses as low as possible, the monitoring circuit is dimensioned high-resistant and a separate holding circuit is provided, the separate holding circuit having a controlled dependency on the low control current in the monitoring circuit. In the disconnect case, the control current also suffices to hold the shut-off device in the disconnect condition when an electrode is broken.

5 Claims, 2 Drawing Figures

ARRANGEMENT FOR SHUTTING OFF AN INVERTER

BACKGROUND OF THE INVENTION

1. Field of the Invention

The present invention relates to an arrangement for shutting off an inverter which feeds at least one lamp circuit having a discharge lamp and heatable electrodes, the inverter comprising a bistable shutoff device which flips into the disconnected condition and shuts off the inverter when the integral of the current in a lamp circuit reaches a shut-off limit value and which is held in the disconnect condition dependent on a monitoring current in a monitoring circuit and which flips back to its normal condition when the holding current flowing thereover falls below a flyback limit value, and in which a series connection of a respective electrode of each lamp is provided in the monitoring circuit.

2. Description of the Prior Art

An arrangement of the type described above is disclosed in the International Patent Application PCT/DE 82/00155 and has the advantage that the shut-off of the inverter triggered by a malfunction is canceled when the faulty lamp is removed, i.e. a separate power system disconnect is not required. However, the monitoring circuit must thereby be dimensioned such that the minimum holding current required for the lowest feed voltage under consideration can flow thereacross, the minimum holding current lying above the flyback limit value at which the shut-off device is reset into the normal condition.

During normal operation, though, this holding current causes additional losses that are of particular significance when a resistor of the monitoring circuit is connected in parallel to the oscillating capacitor of the inverter.

SUMMARY OF THE INVENTION

It is therefore the object of the present invention to reduce the aforementioned additional losses.

According to the invention, the above object is achieved in an arrangement of the type set forth above which is characterized by the provision of a separate holding circuit having a controllable resistor for the holding current of the shut-off device and the monitoring circuit is only dimensioned for the monitoring current, and in that the controllable resistor is controlled in dependence on the monitoring current such that a holding current of sufficient magnitude can flow over the holding current only when the shut-off device is in its disconnected condition. The monitoring circuit can therefore be dimensioned all the more high-resistant the greater the sensitivity of the controllable resistor in the holding circuit.

The application of the invention is particularly advantageous given an inverter whose start-up is dependent on the voltage of a starting capacitor which, in turn, is connected to a voltage divider extending over the monitoring circuit and whose discharge circuit is closed when the shut-off device is in the disconnect condition. The invention thereby enables the monitoring circuit and the holding circuit to be dimensioned independently of one another such that the shut-off device is sure to remain in this condition even given the lowest feed voltage, even when an electrode in the monitoring circuit is broken. The intermittent shut-off and restart of the inverter that has been previously observed can be avoided by way of a corresponding dimensioning. Identified in particular as a cause thereof is that the current flowing in the monitoring circuit, given a broken electrode, did not in fact suffice to maintain the shut-off condition given all feed voltages which could be considered, but was sufficiently high in order to charge the starting capacitor to the response value of the inverter.

The controllable resistor in the holding circuit is preferably a transistor including a control circuit connected in parallel with a resistor and the monitoring circuit.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
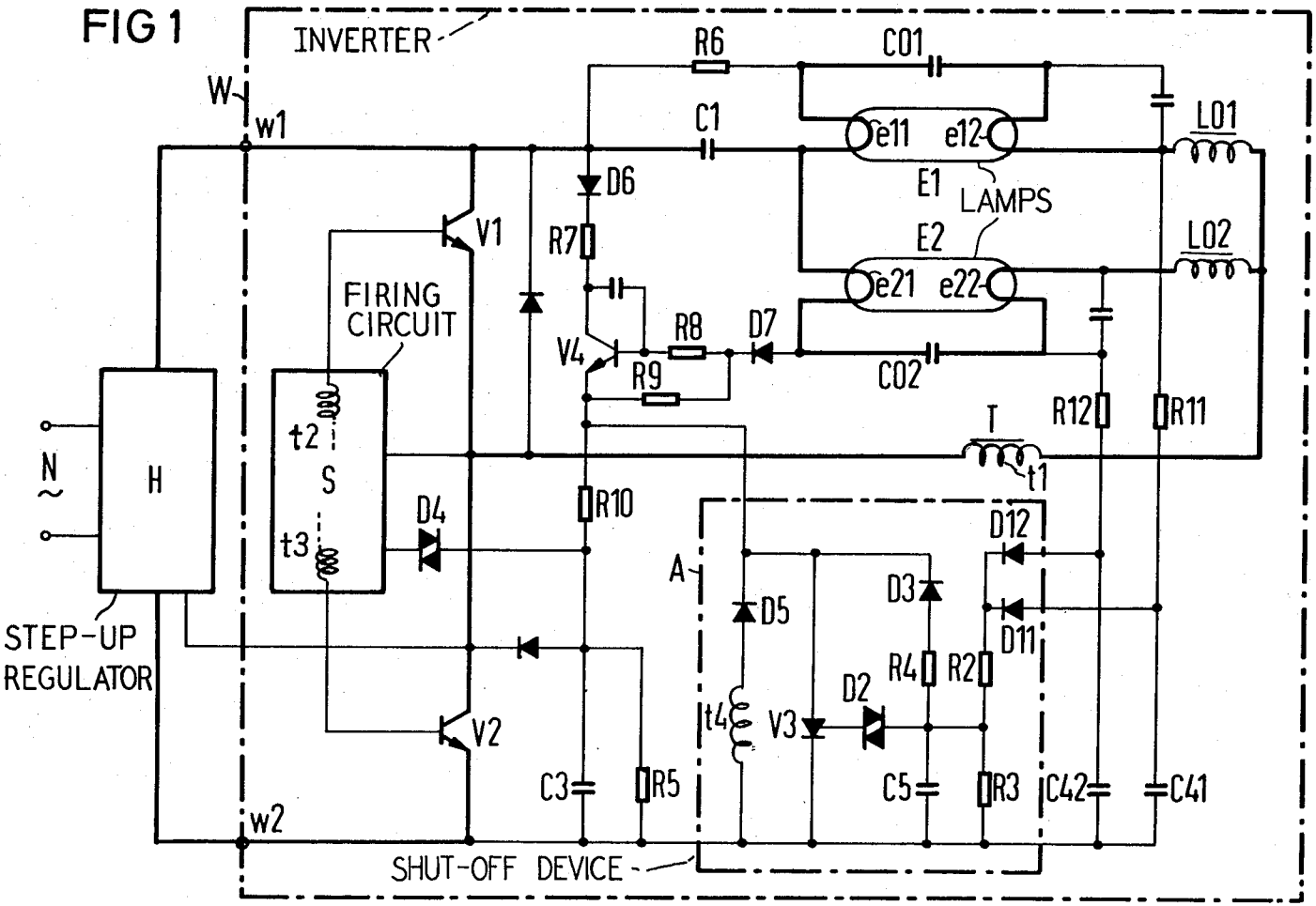
FIG. 1 is a schematic circuit diagram of a shut-off arrangement constructed in accordance with the present invention.

An inverter W is supplied over terminals w1, w2 with a feed voltage source by way of a step-up regulator H which, in turn, is connected to an alternating current network N. A pair of transistors V1 and V2 are alternately driven by a firing circuit S and are connected in series with one another between the terminals w1 and w2. The firing circuit S contains secondary windings t2 and t3 of a saturation transformer T which has a primary winding t1 connected in series with an oscillator capacitor C1 and a load circuit parallel to the transistor V1 therebetween. The load circuit comprises two parallel, identically-constructed lamp circuits each containing a series oscillating circuit CO1, LO1; CO2, LO2 and heatable electrodes e11, e12; e21, e22 of a pair of discharge lamps E1 and E2, whereby the respective capacitor of the series oscillating circuit is connected between the electrodes of a lamp.

The operating frequency of the inverter is essentially defined by the saturation transformer T and lies somewhat higher than the resonant frequency of the series oscillating circuits connected in the lamp circuits.

A bistable shut-off device A provides a lasting disconnect of the inverter W when the time integral of the current in one of the lamp circuits exceeds a predetermined limit value. To this end, the bistable switch device comprises a thyristor V3 having a control path connected across a switch diode D2 to a capacitor C5 which is connected in parallel to the switching path of the thyristor V3 across a discharge branch which comprises a resistor R4 and a diode D3. The capacitor C5 has a resistor R3 connected in parallel therewith, the resistor R3, together with a further resistor R2, forming a voltage divider which is connected to two capacitors C41, C42 by way of two decoupling diodes D11, D12. The capacitors C41, C42, together with respective resistors R11, R12 form a voltage divider at which a voltage dependent on the current in the lamp circuits appears. To that end, each voltage divider, given a driven transistor V2 of the inverter, is connected in parallel to a choke inductor LO1 or, respectively, LO2 of the series oscillating circuits. Therefore, when one of the lamps does not light, its lamp circuits then operate in an oscillating mode in accordance with the presumption and such a high voltage appears at the appertaining inductor and at the voltage divider connected thereto that the thyristor V3 of the shut-off device A is driven in the on condition after a certain time interval. The thyristor V3 then short circuits a secondary winding t4 of the saturation transformer over a diode D5 so that the inverter can no longer oscillate. The load circuit of the thyristor is connected to the terminals w1 and w2 by way of a holding circuit. The holding circuit comprises a diode D6, a resistor R7 and a transistor V4 connected in series. Further, by way of a resistor R10, the thyristor V3 is connected in the discharge circuit of the starting capacitor C3 whose voltage is supplied to the firing circuit S by way of a switch diode D4. The inverter begins to oscillate when the voltage at this starting capacitor reaches a limit value defined by the switch diode. The starting capacitor is connected to a resistor R5 which is connected to the d.c. feed, by way of with the resistor R10 and the monitoring circuit. The monitoring circuit thereby contains a resistor R6, the electrode e11, e21, a diode D7 and a resistor R9. The control segment of the transistor V4 is connected parallel to the resistor R9 by way of a resistor R8.

Since the holding current need no longer flow over the monitoring circuit, the holding current, and therefore the voltage divider encompassing the same, can be dimensioned correspondingly high-resistant for the capacitor C3 so that it causes only negligibly slight losses in normal operation (when the shut-off device is in its normal condition). The voltage divider then need only be dimensioned such that the start-up limit value of the voltage is reached at the capacitor C3 given the lowest feed voltage being considered as well as given intact electrodes, presuming that the shut-off device is in its normal condition. The sensitivity of the transistor V4 and its control current are then to be dimensioned such that the essentially constant current flowing, given a broken electrode, suffices in order to drive the transistor into saturation, whereby it is presumed that the shut-off device A is in its disconnect condition and the current then flowing over the holding circuit lies above the flyback limit value $I_{H1}$ of the shut-off device A, i.e. the necessary minimum holding current $I_{H2}$ flows given the lowest feed voltage under consideration.

Figure 2:
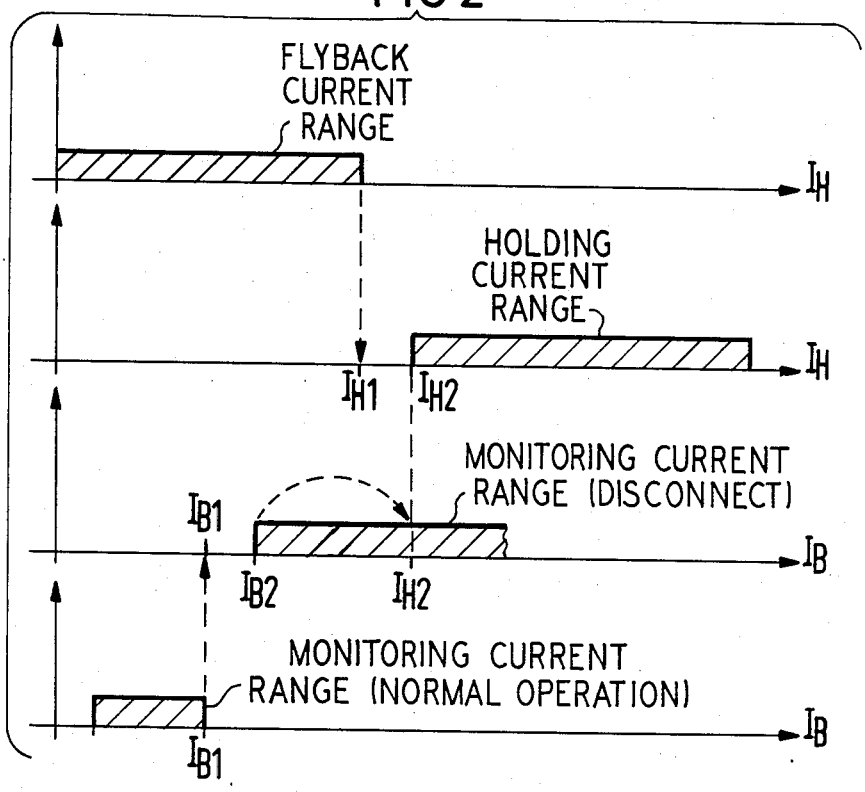
FIG. 2 is a graphic illustration of various limiting values to be considered in practicing the present invention.

The relation of these currents and current ranges is illustrated in FIG. 2. The first line shows the position of the flyback range which ends with the flyback limit value $I_{H1}$. The second line illustrates the range of the admissible holding currents $I_H$ whose minimum holding current $I_{H2}$ has a safety interval from the flyback limit value $I_{H1}$. The third line illustrates the range of monitoring currents $I_B$ possible in the disconnect condition of the device A, this range extending into the flyback range. The transistor V4, however, causes that at least the minimum holding current $I_{H2}$ flows in the holding circuit even given the lowest feed voltage and a broken electrode (monitoring current $I_{B2}$).

Finally, the last line illustrates the range of the monitoring current $I_B$ flowing from over the voltage divider of the starting capacitor C3 during normal operation. The voltage divider is dimensioned such that the maximum value $I_{B1}$ of the monitoring current lies below the minimum response value $I_{B2}$, i.e. the transistor V4 is practically nonconducting during normal operation.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. An arrangement for shutting off an inverter which feeds at least one lamp circuit with a discharge lamp which has heatable electrodes, comprising:

a bistable shut-off device operable in response to the current in the lamp circuit to switch to a disconnect condition to turn off the inverter when the integral of the current in the lamp circuit reaches a shut-off limit value, the bistable shut-off device being held in said disconnect condition by a holding current and switching back to normal condition when the lamp circuit is disconnected by removing the lamp electrode from the lamp circuit and therefore holding current falls below a predetermined flyback limit value;

a monitoring circuit including at least one electrode of the at least one discharge lamp and operable to provide a monitoring current; and a holding circuit connected to said bistable shut-off device including a controllable resistor and providing the holding current as long as the electrode of the at least one lamp is included in the monitoring circuit, said controllable resistor having a resistance controlled by the monitoring current to provide a holding current equal to or greater than a minimum holding current when said bistable shut-off device is in its disconnect condition.

2. The arrangement of claim 1, and further comprising:

a voltage divider, included in said monitoring circuit; and a starting capacitor connected to said voltage divider and to the inverter, said bistable shut-off device including a discharge circuit connected to said starting capacitor, the voltage on said starting capacitor, having a restart value for the inverter when said shut-off device is in its normal condition.

3. The arrangement of claim 2, wherein:

said voltage divider is dimensioned such that the monitoring current flowing therethrough, given a predetermined maximum feed voltage, intact electrodes, and given the normal operation of the shut-off device, lies below a minimum response value which is flowing under the conditions of a broken electrode, of a predetermined minimum feed voltage and of the disconnect condition of said shut-off device.

4. The arrangement of claim 3, wherein:

said holding circuit comprises a transistor as said controllable resistance, and a control circuit including a resistor of said monitoring circuit connected to control said transistor.

5. The arrangement of claim 4, wherein:

said control circuit is constructed to operate said transistor in saturation in response to a monitoring current, given a broken electrode, which is equal to or greater than the predetermined minimum response value when said shut-off device is in its disconnect condition.

* * * * *